US005604942A

United States Patent [19]

Allevato et al.

[11] Patent Number: 5,604,942

[45] Date of Patent: Feb. 25, 1997

[54] SIDE RAIL FOR BED

[75] Inventors: Eugene F. Allevato; Everett A. d'Entremont, both of Burlington; Mits Sumiya, North York, all of Canada

[73] Assignee: M.C. Healthcare Products Inc., Beamsville, Canada

[21] Appl. No.: 519,005

[22] Filed: Aug. 24, 1995

[51] Int. Cl.[6] ..... A47C 21/08

[52] U.S. Cl. ..... 5/428; 5/430

[58] Field of Search ..... 5/425, 427, 428, 5/429, 430

[56] References Cited

U.S. PATENT DOCUMENTS

| | | | |
|---|---|---|---|
| 3,100,899 | 8/1963 | Wright | 5/430 |
| 3,932,903 | 1/1976 | Adams et al. | 5/430 X |
| 4,612,679 | 9/1986 | Mitchell | 5/430 X |
| 4,747,171 | 3/1988 | Einsele et al. | 5/429 X |

*Primary Examiner*—Michael F. Trettel
*Attorney, Agent, or Firm*—Rogers & Scott

[57] ABSTRACT

The invention provides a side rail assembly for use with an institutional bed. The assembly includes provision to move a vertical frame from an upper or deployed position where it is generally above the mattress on the bed, to a lowered position generally below and outside the mattress. The frame can then be moved longitudinally from the lowered position into a stored position below the mattress so that the frame will not interfere with an attendant who is assisting the patient. Further, the frame will then have no impact on access to the bed. The side rail assembly also includes a balance assembly to counterbalance the weight of the frame so that the frame is unlikely to cause accidental injury to a patient as the frame is moved vertically.

18 Claims, 5 Drawing Sheets

SIDE RAIL FOR BED

FIELD OF THE INVENTION

This invention relates to institutional beds of the type used in hospitals and nursing facilities, and more particularly to a safety side rail assembly for such a bed.

BACKGROUND OF THE INVENTION

Institutional beds are equipped with features which permit the bed to be used by patients having a variety of conditions and ailments. In some instances provision has to be made to ensure that the patient can not move sideways and fall off the bed. This is often done by including adjustable side rail assemblies attached to the bed and having a vertical frame moveable between an upper or deployed position to contain the patient, and a lowered position to provide normal access to the bed.

Side rail assemblies may create difficulties which are detrimental to the use of such structures. For instance, the frame has to be strong and is consequently heavy. This is dangerous if the frame can move downwardly without restraint because the open frame can fall on the feet or hands of a patient. Also, such a frame requires considerable strength to return it to the deployed position.

A further consideration in designing a side rail assembly is the amount by which the assembly projects outwardly from the side of the bed. On of the one hand there should be significant clearance between the frame and the bed to minimize the risk of trapping fingers, hands and feet, while on the other hand the frame should be close to the bed to allow attendants to reach the patient without undue bending caused by the lowered frame separating the attendant from the bed. Also, the position of the frame may be a factor for placing the patient on the mattress.

SUMMARY OF THE INVENTION

The invention provides a side rail assembly for use with an institutional bed. The assembly includes provision to move a vertical frame from an upper or deployed position where it is generally above the mattress on the bed, to a lowered position generally below and outside the mattress. The frame can then be moved longitudinally from the lowered position into a stored position below the mattress so that the frame will not interfere with an attendant who is assisting the patient. Further, the frame will then have no impact on access to the bed.

The side rail assembly also includes a balance assembly to counterbalance the weight of the frame so that the frame is unlikely to cause accidental injury to a patient as the frame is moved vertically.

The invention will be better understood with reference to the following description and drawings.

DETAILED DESCRIPTION OF THE PREFERRED EMBODIMENT

Figure 1:
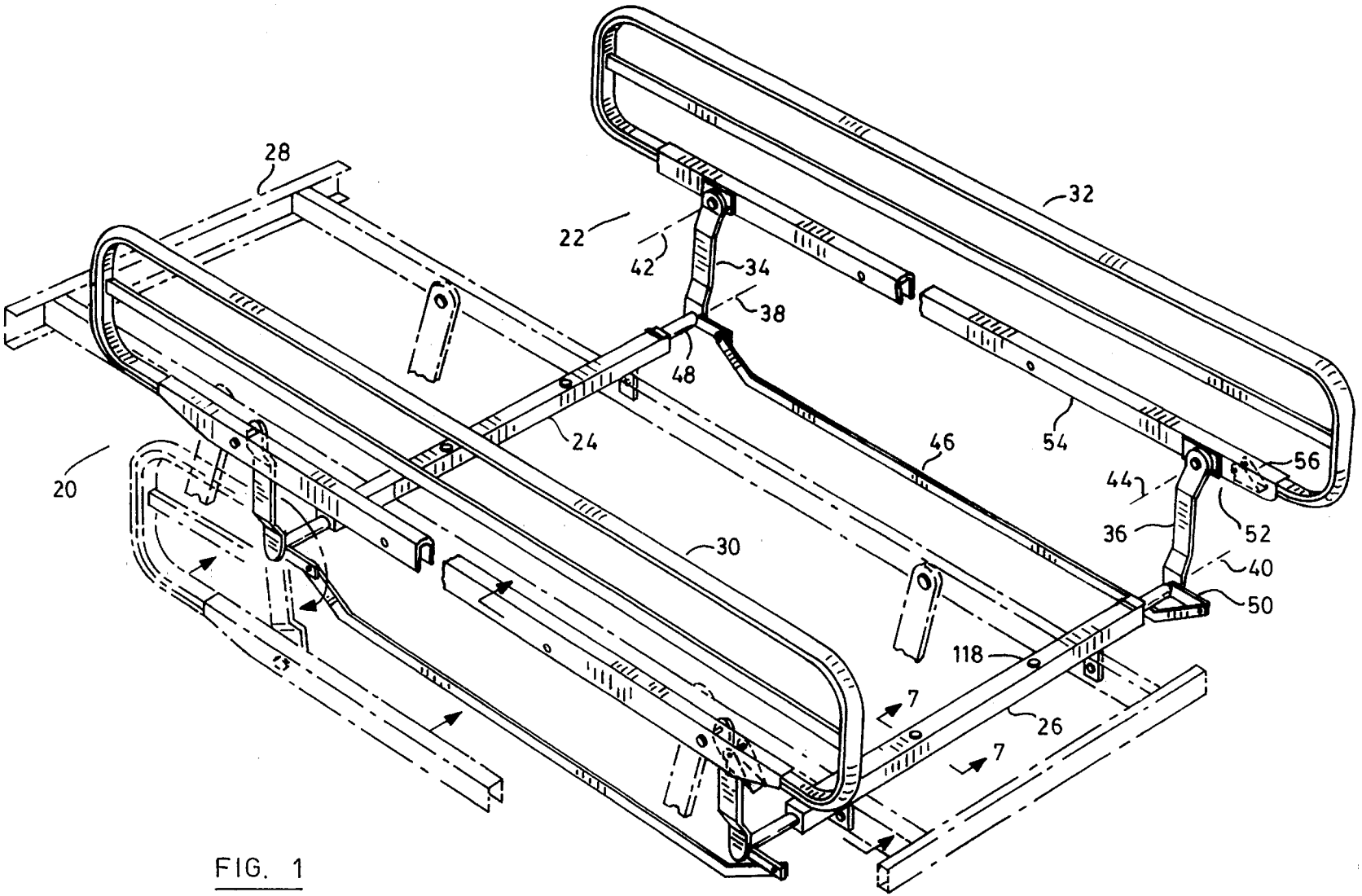
FIG. 1 is a somewhat schematic perspective view illustrating a pair of side rail assemblies shown in a deployed position about a mattress support structure of a bed shown ghost outline, one of the frame of the side rail assemblies also being shown partly in ghost outline to illustrate a lowered position.

Reference is first made to FIG. 1 which illustrates first and second side rail assemblies designated generally by the numerals 20, 22. The assemblies share a pair of mounting members 24, 26 which in use are attached to a mattress support structure 28 shown in ghost outline. In FIG. 1, the side rail assemblies are shown in a deployed position with respective frames 30, 32 generally above the level of a mattress which would rest on structure supported by the mattress support structure 28. Also in FIG. 1, the frame 30 is shown in ghost outline where it would be when the frame is in a lowered position, there being a corresponding position (not shown) for the frame 32.

The side rail assemblies are similar-in construction and any pans described with reference to one of the frame assemblies are duplicated in the other frame assembly. The frame assemblies are shown in pairs because this would be the normal arrangement used in association with a bed. However, a single assembly could be used where necessary.

In general terms, the assembly 32 includes a pair of similar swing arms 34, 36 which are pivotally mounted to the respective mounting members 24, 26 for rotation about respective first and second parallel axes 38, 40 at the proximate ends of the swing arms. The distal ends of the swing arms are pivotally mounted to the frame 32 for rotation about third and fourth axes 42, 44 and the parallel arrangement is maintained by an elongate link 46 which is pivotally mounted to a pair of cranks 48 attached one to each of the swing arms 34, 36 for radial movement with the swing arms. The distal end of the swing arm 36 is associated with a balance assembly designated generally by the numeral 52 and contained within a hollow lower element 54 of the frame 32 as will be described. A latch 56 shown in broken outline can be operated manually to release the balance mechanism and permit the frame 32 to be moved downwardly causing the swing arms to rotate about the before mentioned parallel axes.

Figure 2:
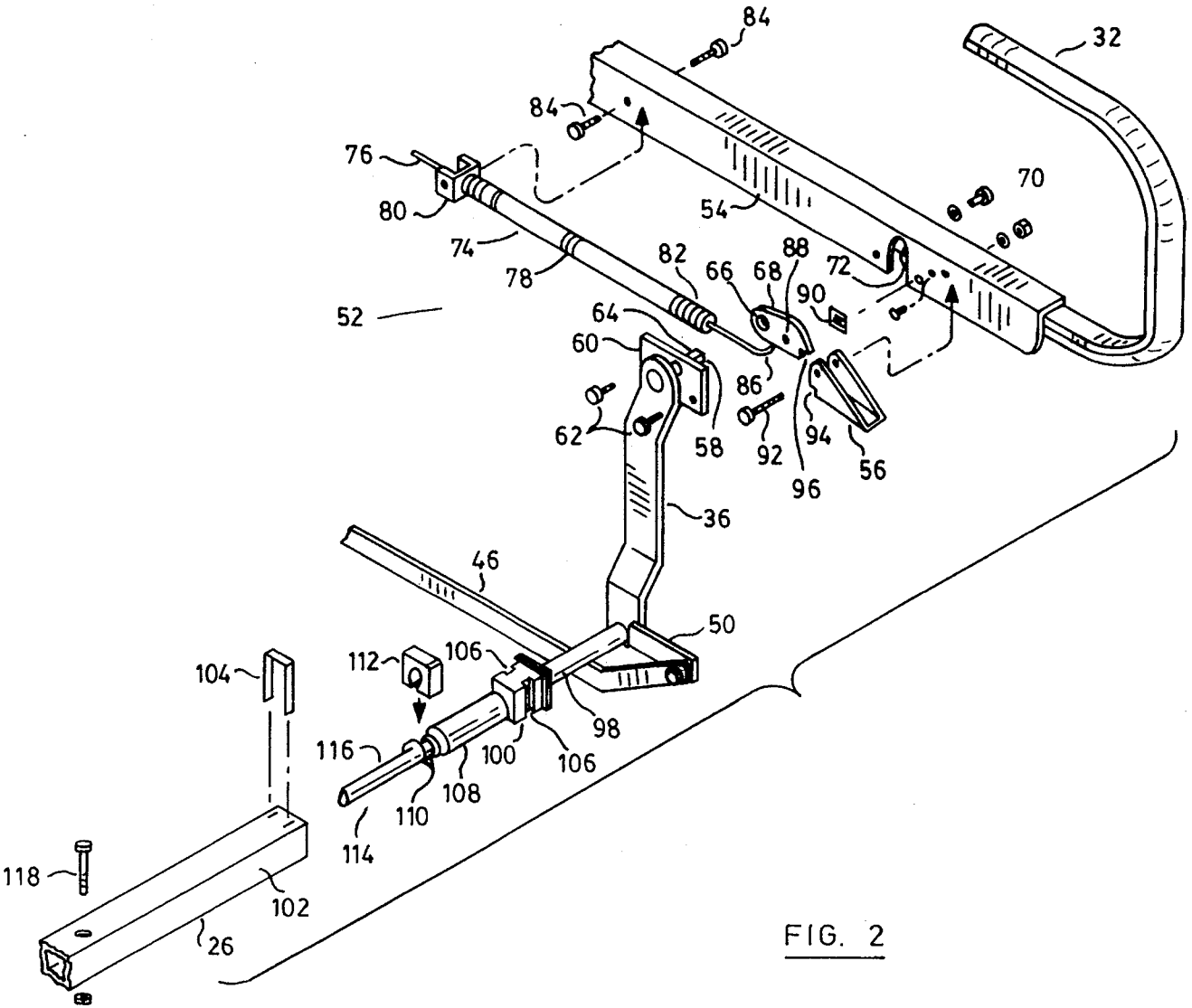
FIG. 2 is an exploded perspective view of a part of one of the side rail assemblies to illustrate details of a balance assembly.

Reference is next made to FIG. 2 to describe the balance assembly 52. This view also illustrates details of the mounting member 26 which will also be described with reference to this figure.

The distal end of the swing arm 36 includes a stub axle 58 extending through a bearing plate 60 which is adapted to be placed inside to the lower element 54 and held in place by a pair of rivets 62. The stub axle includes a flat 64 for engagement in a correspondingly shaped opening 66 in a short crank 68 which is welded to the stub axle and a short set screw 70 passes through the far upright wall (not seen) of the lower element 54 and into the stub axle to stabilize the assembly. It will be seen from FIG. 2 that the clearance for the stub axle 58 is provided by an upwardly extending cutout 72 in a side of the hollow U-shaped lower element 54. Once these parts are assembled and the bearing plate 60 affixed to the lower element 54, an energy storage element 74 can be assembled. This element consists of a central rod 76 passing through an elongate compression spring 78 retained between a U-shaped end piece 80 and an adjustable stop 82 at the other end. The end piece is shaped to fit within the channel shaped lower element 54 and retained in place by a pair of rivets 84 which engage in the element 54 and provide an anchor for the end piece 80. Also, this end piece has a clearance opening to permit the rod 76 to slide and tilt slightly, and at the other end, the rod has an angled end 86 formed to be at right angles to the remainder of the rod for engagement in an opening 88 in the crank. The rod is retained in the crank 68 by a cap 90 which is frictionally engaged on the rod to retain the rod in place. As will be described, energy is stored in the spring to assist in elevating the frame 32 from the lowered position to the deployed position.

The balance assembly 52 also includes the latch 56 which is pivotally mounted by a suitable rivet 92 engaged in an opening provided in the element 54 for the purpose. The latch is formed from a piece of metal by bending it into a U-shape to form a step 94 which engages under an nose 96 on the crank 68. As will be described, this prevents rotation of the crank and hence the swing arm 36 for retaining the frame 32 in the deployed position.

The operation of the balance assembly will be described more fully with reference to FIGS. 3 to 6.

Returning to FIG. 2, the proximal end of the swing arm is attached to a shaft 98 extending along the second axis 40 seen in FIG. 1. The shaft is accommodated in a bearing block 100 which is normally engaged in a square sectioned tubular element 102 forming part of the mounting member 26. The bearing block 100 is held in place by a removable staple 104 engaged through suitable openings in the element 102 for location in slots 106 provided in the sides of the bearing block. Further support for the shaft 98 is provided by a sleeve 108 attached to the bearing block 100 and the shaft 98 is reduced to a neck at 110 to receive a stop 112 which is clipped over the neck. This prevents the shaft 98 from being withdrawn completely through the bearing block 100 without first removing the staples 104.

As also seen in FIG. 2, the shaft 98 terminates at a generally cylindrical end portion 114 having a flat 116 for purposes which will be described. However for the moment it is sufficient to understand that this fiat provides clearance for the shaft to pass a restrictor 118 (in the form of a rivet) when the conditions are right to do so. The restrictor is welded in place.

Figure 3:
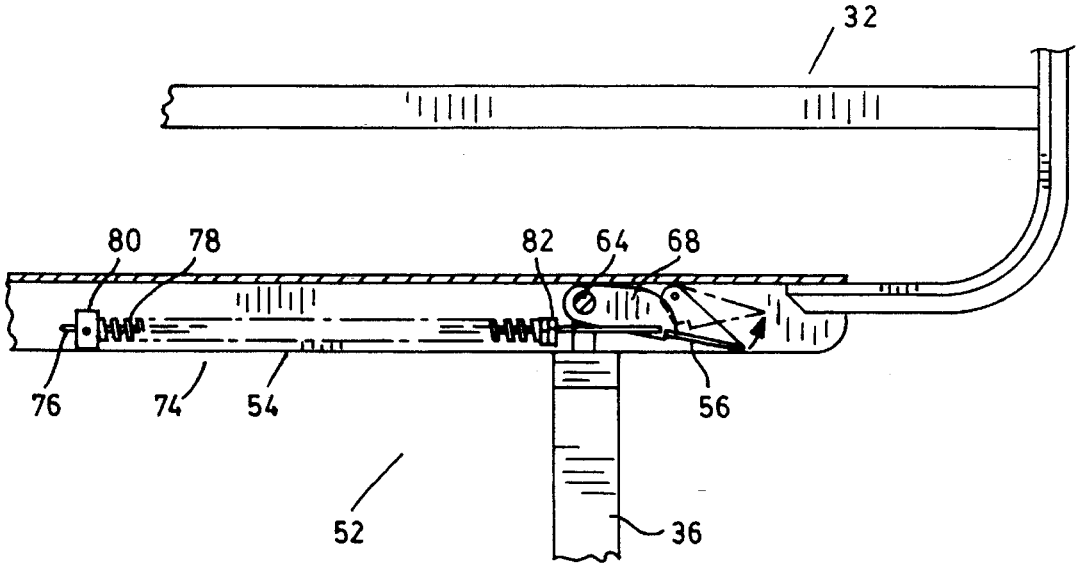
FIG. 3 is a side view illustrating a part of a frame with some of the frame in section and showing the balance assembly with the frame in the deployed position.

Reference is next made to FIG. 3 to further explain the operation of the balance assembly 52. As seen in this sectional view, the crank 68 is angled slightly downwardly with the swing arm 36 upright. The spring extends generally horizontally and is in compression between the end piece 80 and the stop 82. Consequently, the spring guided by the rod 76, is attempting to push the crank in an anti-clockwise direction. However, there is insufficient energy stored in the spring at this point to elevate the frame which in effect is tending to drop downwardly resisted by the latch 56 in engagement with the crank 68. When the user decides to lower the frame 32, finger pressure is used to lift the latch upwardly to release the crank. At the same time the user naturally holds the frame and starts to let it fall. The frame then moves gently towards the position shown in FIG. 4 and as the stop 82 moves towards the anchored end piece 80 thereby storing energy in the spring to resist downward movement of the frame. It will be noted that as the movement continues, the line of action of the spring 54 moves away from the stub axle 58 resulting in a greater torque arm about the stub axle to resist downward motion. With proper selection of spring, weight of frame, and adjustment of the stop 82, it is possible to balance the frame in this position.

Figure 5:
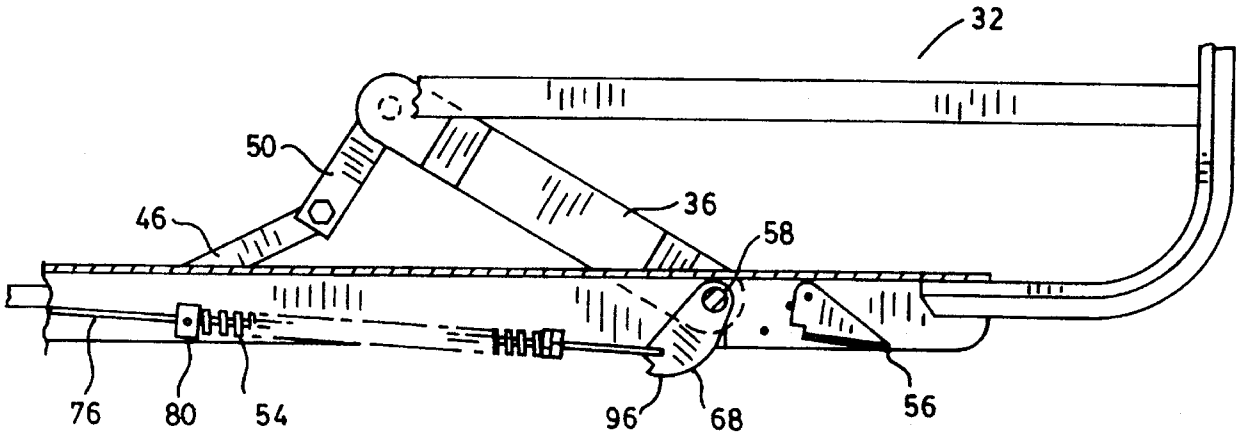
FIG. 5 is a view similar to FIG. 4 and further illustrating lowering of the frame.

The user continues to move the frame downwardly by applying a very gentle force which moves the assembly towards the position shown in FIG. 5. Here the spring is further compressed and this motion continues to the FIG. 6 position where the spring is fully compressed storing as much energy as possible ready to elevate the frame to the upper or deployed position from the lowered position shown in FIG. 6. It should be noted in FIG. 6 that the line of action of the spring is now slightly above the stub axle thereby providing an over centre action to hold the frame positively in the lowered position. Also, the swing arm is not vertical so that if a new user simply tries to lift the frame, the angled arm will cause the frame to move with the upward component and the user will intuitively accept the swing action. Without the angled position for the arm 36, an upward force would have no effect since the arm would resist all upward force.

Figure 4:
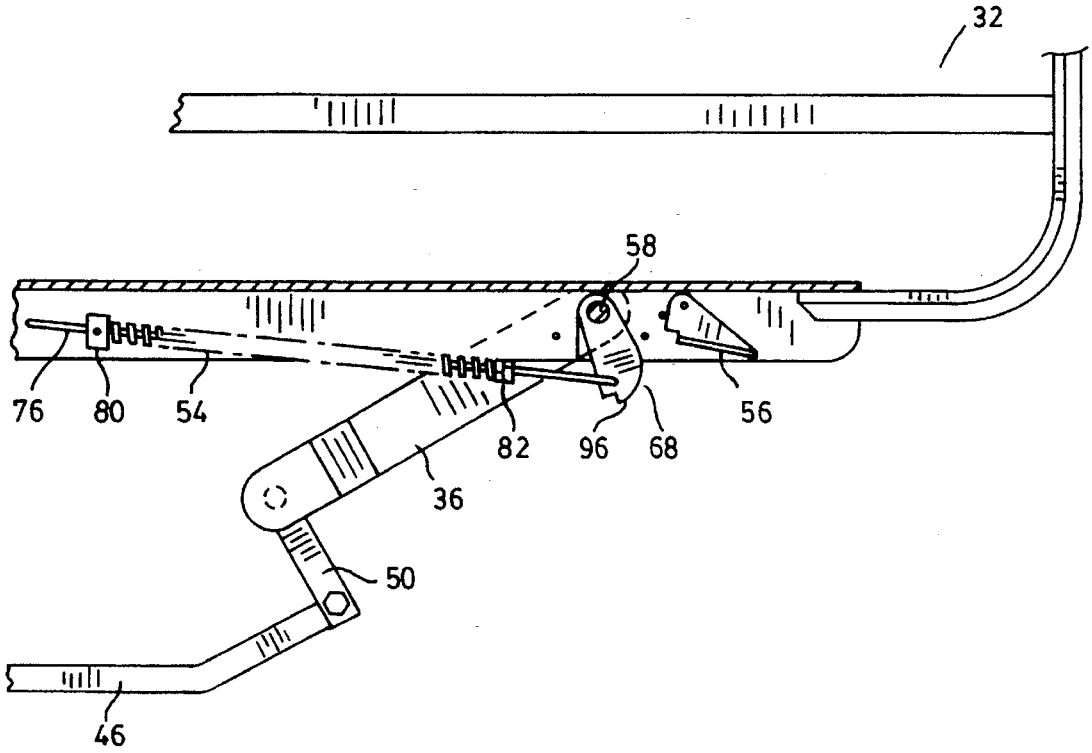
FIG. 4 is a view similar to FIG. 3 and showing the frame as it is being moved downwardly from the deployed position to the lowered position.
Figure 6:
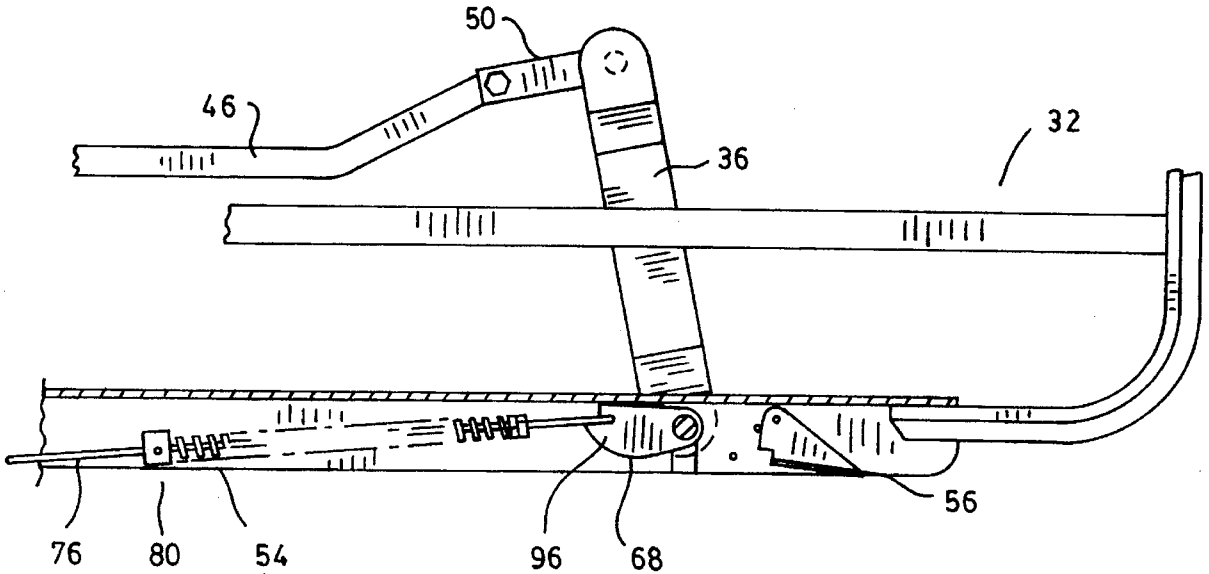
FIG. 6 is a further view similar to FIG. 5 and showing the frame in the lowered position.

When the user is ready to elevate the frame, a gentle force will move the spring from the FIG. 6 position past the over centre and allow the spring to assist in elevating the frame upwardly through FIGS. 5, 4, and then to FIG. 3.

It is the natural result of the swing arm action that the initial movement from the extreme positions requires very little force because the frame is essentially moving horizontally initially. Where the frame is moving entirely vertically, the maximum moment arm is provided at the crank to maximize the use of the spring in assisting to balance the weight of the frame.

Figure 7:
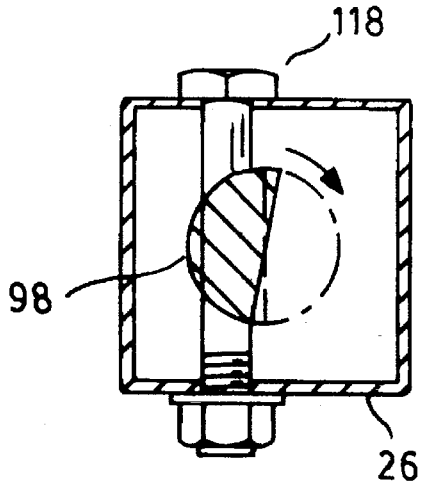
FIG. 7 is a sectional view on line 7-7 of FIG. 1 and showing the position of parts with the frame in the deployed position, the ghost outline showing these parts when the frame is in the lowered position.

Reference is next made to FIG. 7 which is a sectional view on line 7—7 of FIG. 1. Here it can be seen that the bolt 118 mentioned with reference to FIG. 2 is located in the mounting member element 26 offset with respect to the axis of the shaft 98. Because the shaft is provided with a semi-circular cutout, the arrangement permits the shaft to move past the restrictor 118 in certain positions. In the position shown in FIG. 7, the restrictor stands in front of the end of the shaft preventing translational movement of the shaft. However, when the side rail assembly is in the position shown in FIG. 6, the shaft is then in the ghost outline position where it will clear the restrictor if moved towards the restrictor. This allows the side rail assembly to be moved from the lowered position where it is below and outwardly of the mattress to a stored position where it is below and under the mattress. This is achieved by movement of the shaft 98 (FIG. 2) through the bearing housing 106 and sleeve 108.

Figure 8:
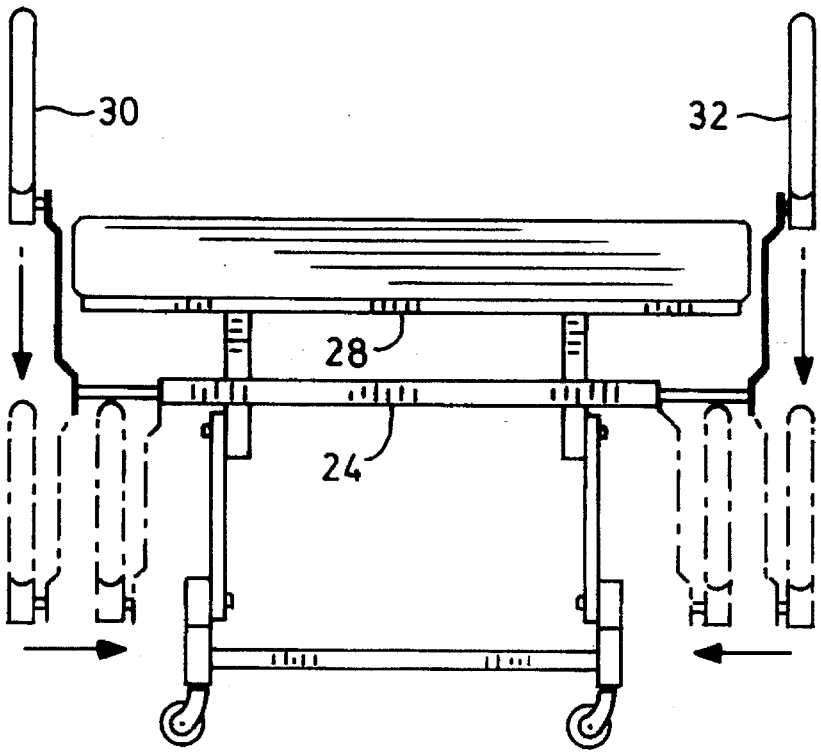
FIG. 8 is a diagrammatic end view of a bed showing the movement of the frames from the deployed position, down to the lowered position, and inwardly to a stored position, the latter two positions being shown in ghost outline.

FIG. 8 illustrates the various positions for the side rail assembly. In full outline the frames 30, 32 are in a deployed position generally above and outwardly of a mattress 120. The frames can then be moved vertically downwardly to the lowered positions shown in ghost outline directly below the deployed positions, and then from the lowered positions the frame can be moved inwardly to a stored position also shown in ghost outline in FIG. 8.

It will be evident to those skilled in the art that the embodiment described above is exemplary of the invention and that other embodiments are within the scope of the invention as claimed.

We claim:

1. A side rail assembly for a bed having a mattress support structure for supporting a mattress, the assembly comprising:

a pair of mounting members for attachment to the mattress support structure;

a pair of swing arms having proximal ends pivotally connected to respective ones of the mounting members for rotation in a vertical plane about respecting parallel first and second axes;

a link pivotally coupled to the swing arms adjacent the mounting members;

a frame pivotally coupled to the distal ends of the swing arms about respective third and fourth axes parallel to said first and second axes such that the frame and the link cause each of the swing arms to maintain a common angular relationship with the vertical at all times, so that the frame maintains a longitudinal orientation as the swing arms rotate and the frame moves downwardly from a deployed position generally above the mattress support structure to a lowered position generally below the mattress support structure;

a crank connected to the distal end of one of the swing arms for angular movement with that swing arm about a selected one of said third and fourth axes;

an elongate compression spring having a line of action and being anchored to the frame and coupled to the crank at a point offset from said selected axis, whereby movement of the frame from the deployed to the lowered position will store energy in the compression spring ready for use to assist elevating the frame back to the deployed position, the distance between said line of action of the spring and said selected axis varying as the frame is moved, the distance being a maximum when the swing arms are substantially horizontal, and said line of action crossing said selected axis as the frame reaches the lowered position to provide an over-centre effect to retain the frame in the lowered position; and a latch cooperating with said crank to releasably retain the frame in the deployed position.

2. A side rail assembly as claimed in claim 1 in which the pivotal connections between the swing arms and the mounting members permits translational movement along said first and second axes to move the frame from the lowered position to a stored position under the mattress support structure.

3. A side rail assembly for a bed having a mattress support structure for supporting a mattress, the assembly comprising:

a pair of mounting members for attachment to the mattress support structure;

a pair of swing arms;

a frame;

pivotal connections connecting the proximal ends of the arms to the mounting members and the distal ends of the arms to the frame so that as the arms rotate in unison, the frame moves vertically between a deployed position generally above the mattress support structure and a lowered position generally below the mattress support structure; and a balance assembly mounted in the frame and including an elongate compression spring and a crank coupled to one of the arms for rotation with this arm about an associated one of the pivotal connections, the compression spring being anchored to the frame and to said crank such that movement of the frame from the deployed to the lowered position will compress the spring thereby storing energy in the spring for use to assist when elevating the frame from the lowered position to the deployed position.

4. A side rail assembly as claimed in claim 3 in which the frame includes a hollow lower element containing the compression spring.

5. A side rail assembly as claimed in claim 3 and further comprising a latch mounted on the frame and operable to releasably retain the frame in the deployed position.

6. A side rail assembly as claimed in claim 4 in which the compression spring has a line of action which varies as the frame moves, and in which the line of action provides an over-centre effect with the frame in the lowered position to locate the frame in the lowered position.

7. A side rail assembly as claimed in claim 1 in which the swing arms are substantially vertical with the frame in the deployed position.

8. A side rail assembly as claimed in claim 7 in which the swing arms do not reach a vertical orientation when the frame reaches the lowered position sufficient to provide an upward component of force when a user attempts to lift the frame vertically with the frame in the lowered position.

9. A side rail assembly for a bed having a mattress support structure for supporting a mattress, the assembly comprising:

a pair of mounting members for attachment to the mattress support structure;

a pair of swing arms having proximal and distal ends and a shaft at the distal end;

the mounting members including bearing blocks for receiving the respective shafts to permit rotation in a vertical plane of the swing arms about respective first and second axes;

a link pivotally coupled to the swing arms adjacent the mounting members;

a frame pivotally coupled to the distal ends of the swing arms about respective third and fourth axes parallel to said first and second axes such that the frame and the link cause each of the swing arms to maintain a common angular relationship with the vertical at all times, so that the frame maintains a longitudinal orientation as the swing arms rotate and the frame moves downwardly from a deployed position generally above the mattress support structure to a lowered position generally below the mattress support structure;

a crank connected to the distal end of one of the swing arms for angular movement with that swing arm about a selected one of said third and fourth axes a compression spring anchored to the frame and to the crank at a point offset from said selected axis whereby movement of the frame from the deployed to the lowered position will store energy in the compression spring ready for use to assist elevating the frame back to the deployed position; and said shafts on the swing arms being moveable longitudinally in the respective bearing blocks to permit movement of the lowered frame inwardly into a stored position beneath the level of the mattress frame.

10. A side rail assembly as claimed in claim 9 in which the bearing blocks are releasably retained in the mounting members to permit removal of the frame and associated swing arms.

11. A side rail assembly as claimed in claim 9 in which the shafts have cut-outs and in which the mounting members include restrictors which prevent translational inward movement when the cut-outs do not align with the respective restrictors, and to allow such movement when the cut-outs are in alignment whereby translational inward motion is possible only when the frame is in the lowered position.

12. A side rail assembly as claimed in claim 11 in which the cut-outs are semi-circular in cross-section.

13. A side rail assembly as claimed in claim 9 in which the bearing blocks are releasably retained in the mounting members to permit removal of the frame and associated swing arms.

14. A side rail assembly as claimed in claim 9 in which the shafts have cut-outs and in which the mounting members include restrictors which prevent translational inward movement when the cut-outs do not align with the respective restrictors, and to allow such movement when the cut-outs are in alignment whereby translational inward motion is possible only when the frame is in the lowered position.

15. A side rail assembly as claimed in claim 9 the frame includes a hollow lower element to which the swing arms are pivotally attached and in which the compression spring is concealed.

16. A side rail assembly as claimed in claim 15 in which the distance between the line of action of the compression spring and said selected axis varies as the frame is moved, said distance being a maximum when the swing arm is substantially horizontal.

17. A side rail assembly as claimed in claim 16 in which said line of action crosses said selected axis as the frame reaches the lowered position to provide an over-centre effect to retain the frame in the lowered position.

18. A side rail assembly as claimed in claim 17 and further comprising a latch cooperating with said crank to releasably retain the frame in the deployed position.

* * * * *